US005969207A

United States Patent [19]

Kozyuk

[11] Patent Number: 5,969,207

[45] **Date of Patent: *Oct. 19, 1999**

[54] METHOD FOR CHANGING THE QUALITATIVE AND QUANTITATIVE COMPOSITION OF A MIXTURE OF LIQUID HYDROCARBONS BASED ON THE EFFECTS OF CAVITATION

[76] Inventor: Oleg V. Kozyuk, 14600 Brookpark Rd., Cleveland, Ohio 44135

[ * ] Notice: This patent issued on a continued prosecution application filed under 37 CFR 1.53(d), and is subject to the twenty year patent term provisions of 35 U.S.C. 154(a)(2).

[21] Appl. No.: 08/555,980

[22] Filed: Nov. 13, 1995

Related U.S. Application Data

[63] Continuation-in-part of application No. 08/191,251, Feb. 2, 1994, abandoned.

[51] Int. Cl.[6] ..... C10G 9/00; B06B 1/00

[52] U.S. Cl. ..... 585/921; 585/922; 585/923; 585/934; 585/925; 422/127; 422/128; 422/312; 208/106

[58] Field of Search ..... 585/921, 922, 585/923, 924, 925; 422/127, 128, 312; 208/106

[56] References Cited

U.S. PATENT DOCUMENTS

| | | | |
|---|---|---|---|
| 2,548,759 | 4/1951 | Allen | 585/921 |
| 2,790,838 | 4/1957 | Schrader | 260/679 |
| 3,049,574 | 8/1962 | Johnson | 260/666 |
| 3,081,257 | 3/1963 | Johnson et al. | 585/921 |
| 3,170,863 | 2/1965 | Spillane et al. | 585/921 |
| 3,408,417 | 10/1968 | Sogawa et al. | 260/679 |
| 3,988,329 | 10/1976 | Zucker | 260/409 |
| 4,136,015 | 1/1979 | Kamm et al. | 208/129 |
| 4,708,787 | 11/1987 | Peters et al. | 208/130 |
| 4,893,275 | 1/1990 | Tanaka et al. | 365/189.9 |
| 5,179,297 | 1/1993 | Hsueh et al. | 307/296.6 |
| 5,300,216 | 4/1994 | Hertzberg et al. | 208/130 |
| 5,492,654 | 2/1996 | Kozjuk et al. | 261/76 |

FOREIGN PATENT DOCUMENTS

| | | | |
|---|---|---|---|
| 0322022 | 6/1989 | European Pat. Off. | 3/12 |
| 0499110 | 8/1992 | European Pat. Off. | 17/693 |

*Primary Examiner*—Walter D. Griffin
*Assistant Examiner*—Thuan D. Dang
*Attorney, Agent, or Firm*—Emerson & Associates; Roger D. Emerson; Timothy D. Bennett

[57] ABSTRACT

The proposed method comprises passing the hydrodynamic flow of liquid hydrocarbons through a flow-through passage accomodating a baffle body providing for a local constriction of the flow; establishing the local flow constriction on at least one portion of the flow-through passage whose cross-sectional profile area is so selected as to maintain such a velocity of the flow on the portion of the passage that promotes the development of a hydrodynamic cavitation field past the baffle body having the degree of cavitation of at least one; processing the flow of a mixture of liquid hydrocarbons in the hydrodynamic cavitation field to initiate chemical transformations of liquid hydrocarbons resulting in a change in the qualitative and quantitative composition of the mixture of liquid hydrocarbons.

20 Claims, 2 Drawing Sheets

METHOD FOR CHANGING THE QUALITATIVE AND QUANTITATIVE COMPOSITION OF A MIXTURE OF LIQUID HYDROCARBONS BASED ON THE EFFECTS OF CAVITATION

This application is a continuation in part of application Ser. No. 08/191,251, filed Feb. 2, 1994, now abandoned.

BACKGROUND OF THE INVENTION

The present invention relates to a method that makes use of the effects of cavitation for changing the qualitative and quantitative composition of a mixture of liquid hydrocarbons. The method can find application in oil processing, petroleum chemistry, and organic synthesis chemistry for producing a variety of fuels, man-made fibers, synthetic alcohols, detergents, rubber-like materials, and plastics.

At present, there are a number of methods in widespread use for changing the qualitative and quantitative composition of a mixture of liquid hydrocarbons used in oil refining.

Oil is essentially a complex composition of closely boiling hydrocarbons and high-molecular hydrocarbon compounds. Oil is the main source for producing all kinds of liquid fuels, such as, gasoline, kerosene, diesel and boiler fuel oil, as well as liquified gases and raw stock for chemical production processes.

Oil processing is carried out with the use of diverse production techniques initiating the chemical transformation of hydrocarbons, which results in changing the qualitative and quantitative composition of a mixture of liquid hydrocarbons.

To this end, there is the extensive use of the cracking process of splitting long-chain hydrocarbons into shorter molecules occurring in the presence of catalysts (catalytic cracking), or by heating hydrocarbons to a temperature range of 500–700° C. under pressure (thermal cracking). Numerous reactions proceed during the cracking process, such as breaking of the carbon bond, redistribution of hydrogen, aromatization, isomerization, breaking and rearrangement of hydrocarbon rings, condensation, and polymerization. Cracking of oil derivatives allows to obtain mixtures of low-boiling hydrocarbons (i.e., gasoline) from high-boiling point hydrocarbons. Unsaturated hydrocarbons resulting from the cracking process find widespread application in the organic synthesis industry.

The catalytic cracking process makes use of alumosilicate catalysts based on zeolites and occurs at a temperature range of 450–550° C. and at a pressure range of 0.1–0.3 MPa.

The catalytic cracking process is used for producing motorfuels and raw stock for petrochemistry. Catalytic reforming is used extensively for increasing the anti-knock properties of gasoline and producing aromatic hydrocarbons (benzene, toluene, xylene). The process is carried out at a temperature range of 480–520° C. and at a pressure range of 1.2–4.0 MPa in the presence of hydrogen and a catalyst.

One of the methods for changing the qualitative and quantitative composition of hydrocarbons is hydrocracking aimed at producing light oils (gasoline, kerosene, diesel fuel). Hydrocracking is conducted at a temperature range of 370–450° C. and at a pressure range of 15–20 MPa in the presence of bifunctional catalysts.

The aforementioned methods for changing the qualitative and quantitative composition of a mixture of hydrocarbons are performed at rather high temperature and high pressure levels in the presence of hydrogen and catalysts which need continuous regeneration during operation. These methods discussed above are highly expensive and energy consuming.

SUMMARY OF THE INVENTION

It is the objective of the present invention to provide a method for changing the qualitative and quantitative composition of a mixture of liquid hydrocarbons which enables hydrocarbons to be processed at lower temperature and lower pressure levels without the use of catalysts in order to simplify and reduce the expense of the process techniques used.

The foregoing objective is accomplished due to a method for changing the qualitative and quantitative composition of a mixture of liquid hydrocarbons, according to the invention, which comprises:

feeding a hydrodynamic flow of liquid hydrocarbons through a flow-through duct or passage or channel provided with a baffle body placed therein, which establishes a local constriction of the hydrodynamic flow of liquid hydrocarbons;

establishing the local constriction of the hydrodynamic flow in at least one portion of the flow-through passage having a cross-sectional profile design which is so selected in order to maintain a prescribed velocity of the hydrodynamic flow on the portion of the flow-through passage that provides for the initiation of a cavitation field featuring the degree of cavitation of not less than one and located past the baffle body;

treating the hydrodynamic flow of a mixture of liquid hydrocarbons in the hydrodynamic cavitation field that initiates chemical transformations of liquid hydrocarbons resulting in a qualitative and quantitative change in the composition of the mixture of liquid hydrocarbons.

A method, according to the invention, exploits the use of the effects of hydrodynamic cavitation. It has been found that, when a mixture of liquid hydrocarbons is exposed to a cavitation field, the cavitation field initiates chemical transformations of the hydrocarbons, that is, chemical reactions such as decomposition, isomerization, cyclization, and synthesis which provide for a change in the qualitative and quantitative composition of a mixture of liquid hydrocarbons without the use of catalysts.

DISCLOSURE OF THE INVENTION

For its principal objective, the present invention provides a method for changing the qualitative and quantitative composition of a mixture of liquid hydrocarbons, which allows chemical reactions such as decomposition, isomerization, cyclization, and synthesis of hydrocarbons to be performed without the use of catalysts and hydrogen, under normal conditions, that is, at room temperature and atmospheric pressure, and, at elevated temperatures and pressure levels. This enables to considerably simplify the implementation of these technological processes, wherein the method is realized, and, to then reduce their energy consumption rate and specific amount of metal used, thereby rendering these processes to be conducted at lower costs.

The foregoing objective is possible due to a method for changing the qualitative and quantitative composition of a mixture of liquid hydrocarbons, comprising the initiation of chemical reactions such as decomposition, isomerization, cyclization, and synthesis, according to the invention, and, the initiation of chemical reactions is carried out by feeding the hydrodynamic flow of a mixture of liquid hydrocarbons through a flow-through passage having a portion that ensures the local constriction of the hydrodynamic flow, and by establishing a hydrodynamic cavitation field of collapsing air bubbles in the hydrodynamic flow that acts on the mixture of hydrocarbons. Such a method enables to carry out chemical reactions such as decomposition, isomerization, cyclization, and synthesis in a mixture of liquid hydrocarbons, thereby changing their qualitative and quantitative composition without the use of catalysts.

The occurrence of hydrodynamic cavitation consists of the formation of filled vapor to gas zones in the fluid flow or on the boundary of the baffle body as a result of a localalized decrease in pressure. The process is carried out in the following manner: The flow of processable hydrocarbons, at a velocity of 1–3 m/sec. is fed into the continuous flow channel. In the localized tapered channel zone, the velocity accelerates to 10–50 m/sec. As a result, in this location the static pressure in the flow decreases to 1–20 kPa. This induces the origin of cavitation in the flow to have the appearance of vapor—filled evaporable hydrocarbon cavities and bubbles. That is, an instantaneous vacuum evaporation of liquid hydrocarbons occurs. In the localized tapered flow channel zone, the pressure of the vapor—hydrocarbons inside the cavitation bubbles is 1–20 kPa. When the cavitation bubbles are carried away in the flow beyond the boundary of the localized tapered zone, the pressure in the flow increases.

The increase in the static pressure drives the instantaneous adiabatic collapsing of the cavitation bubbles. The bubble collapse time duration is $10^{-6}$–$10^{-8}$ sec. This is dependent on the size of the bubbles and the static pressure of the flow. The velocities reached during the collapse of "vacuum" cavitation bubbles are in the range of magnitude of 300–1000 m/sec. In the final stage of bubble collapse, elevated temperatures in the bubbles are realized with a velocity of $10^{10}$–$10^{12}$ K/sec. Under this vaporous-gaseous mixture of hydrocarbons found inside the bubbles, the hydrocarbons mixture reaches a temperature range of 3000–15,000° K. and is present under a pressure range of 100–1500 MPa.

Under these physical conditions inside of the cavitation bubbles, thermal disintegration of hydrocarbon molecules occurs, filling the bubbles, such that the pressure and the temperature here significantly surpasses the magnitude of the analogous parameters of the cracking process.

At the final stage of collapsing bubbles, at a bubble collapse time span of ~$10^{-7}$ sec., there also occurs heating of the fluid adjacent to the bubble zone at a ~0.1–0.4 micron thickness to a temperature of the order of 0.3–0.4 T. (T is the temperature of the gaseous phase inside the bubble). Pressure at the boundaries of the bubble is equal to the pressure inside of the bubble. The parameters, which are attained at the boundaries of the cavitation bubble with liquous phase (pressure and temperature), are totally sufficient for the progress of the "micro-cracking" process in the liquous phase, adjacent to the bubble.

Chemical transformations of hydrocarbon mixtures are derived as a result of sequential-parallel "micro-cracking" reactions inside and on the boundaries of collapsing cavitation bubbles, flowing from the main course of a radical-chain mechanism. For example: In the intitial disintegration of the C—C chain, primary radicals with various molecular masses are formed, $$RH \rightarrow \mathring{R}_{(1)} + \mathring{R}_{(2)};$$

A portion of these is capable of a short term autonomous existence. Others, not possessing in the data conditions a minimal stability condition, disintegrate further with the formation of either stable hydrocarbons or, a stable hydrocarbon and a new radical. For example:

$$\mathring{R}_{(1)} \rightarrow \mathring{R}_{(3)}CH = CH_2 + \mathring{H};$$

$$\mathring{R}_{(1)} \rightarrow \mathring{R}_{(3)} + C_2H_2;$$

$$\mathring{R}_{(1)} \rightarrow R_{(1)}H + R_{(4)}CHR_{(5)};$$

Under this situation, the concentration of free radicals in the mixture increases. Colliding with the molecules of the initial hydrocarbon mixture, the free radicals generate a chain reaction with the formation of new radicals of various structures. For example:

$$RH + \mathring{H} \rightarrow H_2 + R_{(4)}\mathring{C}HR_{(5)};$$

$$R_{(4)}\mathring{C}HR_{(5)} \rightarrow R_{(4)}CH = CH_2\mathring{R}_{(5)};$$

And, with colliding against one another, the radicals form new hydrocarbons. For example:

$$\mathring{R}_{(1)} + \mathring{R}_{(3)} \rightarrow R_{(1)} - R_{(3)};$$

$$\mathring{R}_{(2)} + \mathring{R}_{(5)} \rightarrow R_{(2)} - R_{(5)};$$

$$\mathring{R}_{(5)} + \mathring{H} \rightarrow R_{(5)}H;$$

$$\mathring{H} + \mathring{H} \rightarrow H_2;$$

Ultimately, in the reactions, lesser molecular mass hydrocarbons and molecular carbon products accumulate.

The chemical action of each collapsing cavitation bubble presents itself as a super-position of two processes of "micro-cracking"—a gaseous phase inside the bubble and a liquous phase in the surrounding liquid bubble.

High temperatures inside the bubble increase the thermodynamic probability of the disintegration reaction. Lower temperatures in the liquid surrounding the bubbles promote synthesis reactions. Increasing pressure in this liquid layer in the final stage of the collapsing bubble increases the concentration of reacting substances which promotes the course of polymerization, alkylation and hydrogenation reactions.

Each cavitation bubble serves as an "autonomous" system, where chemical reaction transformations of hydrocarbons are realized.

At the same time, the concentration of cavitation bubbles in the flow formulates a magnitude in the order of $1^8$–$1^{10}1/m^3$, that allows to process up to 10 % of the hydrocarbons from the general flow, which pass through the cavitation field.

The process of breaking of chemical bonds in hydrocarbons and the formation of new compounds resulting from the cavitation effects is called forth by specific physico-chemical effects manifesting themselves during air-bubble collapsing in the flow of hydrocarbons. Collapsing cavitation bubbles are the source of the energy concentration in a liquid medium and provides for its extra-high density inside the phases and at the phase interfaces, which thereby provide a powerful means for the chemical and physical action on a liquid medium, because the cavitation bubbles pass through a low-temperature plasma condition resulting from the cavitation action. The temperature of a collapsing cavitation bubble exceeds 10,000° K. and the pressure amounts to 1000 MPa and above.

In addition, the collpasing of the cavitation bubbles is accompanied by some electrical effects, luminescence, and generation of broad-spectrum shock waves and acoustic vibrations. As a result, the collapsing bubbles act as a kind of catalyst that initiates the progress of chemical reactions.

The most important parameters determining the intensity of the energy effect of the hydrodynamic cavitation field are the degree of cavitation and the processing ratio. The degree of cavitation is determined by the ratio between the characteristic lengthwise dimension of the cavitation field and the cross-sectional dimensions of the baffle body on the portion of a local flow constriction; and, the processing ratio is determined by the number of the cavitation effects zone on the flow of the components under processing. The hydrodynamic flow velocity on the locally constricted portion of the flow-through passage to a great extent influences the lengthwise dimension of the cavitation field and its intensity, and is so selected that the degree of cavitation should be equal to at least one. With the degree of cavitation having such a value, energy conditions arise for an efficient action on a mixture of liquid hydrocarbons at lower temperatures, which in turn may render the process much less expensive and much less complicated.

The method, according to the invention, enables to control the cavitation field intensity due to the appropriately arranged portions of the local flow constriction which depend on the shape of the baffle body.

It is necessary to establish the locally constricted portion of the hydrocarbon flow in the central portion or as close as possible to the center of the flow-through passage. The cavitation field created past the baffle body possesses a high energy potential. Such local flow constriction portions provide for the throttling effect.

It is feasible to establish a hydrodynamic cavitation field substantially across the entire cross-sectional area of a flow-through passage and attain a maximum cavitation field intensity by arranging the local flow constriction portions to be established parallel to one another in the same cross-section of the flow-through passage.

The hydrodynamic flow velocity on the local flow constriction portions is influenced by the flow restriction coefficient which is the ratio between the maximum cross-sectional area of the baffle body and the area of the flow-through passage at the place of the baffle body location.

It is advisable that the hydrodynamic flow of a mixture of liquid hydrocarbons be fed through the flow-through passage with the coefficient of restriction of the hydrodynamic flow to be not less than 0.1. This parameter also allows for adjusting the intensity of the cavitation field so established, that is, the degree of changing the qualitative and quantitative composition of the mixture of liquid hydrocarbons under processing.

A change in the qualitative composition of a mixture of liquid hydrocarbons is also influenced by the temperature of the mixture under processing effective on the portions of the local flow constriction. It is necessary to maintain the flow temperature within a range of 10 and 500° C. It is within this temperature range that the viscosity of hydrocarbons required for the hydrodynamic flow is maintained and any possibility for the formation of a gaseous phase in the mixture of liquid hydrocarbons is prevented.

BRIEF DESCRIPTION OF THE DRAWINGS

Some specific examples of embodiments are presented of the herein-proposed method for changing the qualitative and quantitative composition of a mixture of liquid hydrocarbons, according to the invention, presented with reference to the accompanying drawings, wherein.

DETAILED DESCRIPTION OF THE INVENTION

The method, according to the invention, consists of feeding a hydrodynamic flow of a mixture of liquid hydrocarbons via a flow-through passage, wherein a baffle body is placed, with the baffle body having such a shape and being so arranged that the flow of liquid hydrocarbons is constricted on at least one portion thereof. The cross-sectional profile design of the flow constriction area is selected so as to maintain such a flow velocity that provides for the creation of a hydrodynamic cavitation field past the baffle body. The flow velocity in a local constriction is increased while the pressure is decreased, with the result that the cavitation cavities or voids are formed in the flow past the baffle body, which on having been disintegrated, form cavitation bubbles which determine the structure of the cavitation field.

The cavitation bubbles enter into the increased pressure zone resulting from a reduced flow velocity, and collapse. The resulting cavitation effects exert a physico-chemical effect on the mixture of liquid hydrocarbons, thus initiating chemical reactions such as decomposition, isomerization, cyclization, and synthesis.

In order to utilize the energy generated in the cavitation field to the best advantage, the degree of cavitation of the cavitation field must not be below one unit. It is in only such a case that the occurring cavitation effects will provide for a change in the qualitative and quantitative composition of a mixture of liquid hydrocarbons.

It is necessary, with a view to increasing the cavitation effects, to feed the hydrodynamic flow through the flow-through passage having a flow restriction coefficient of not below 0.1 and to maintain the flow temperature on the local flow constriction area within a temperature range of 10 and 500° C., depending on the composition and physico-chemical properties of the mixture of hydrocarbons involved.

Figure 1:
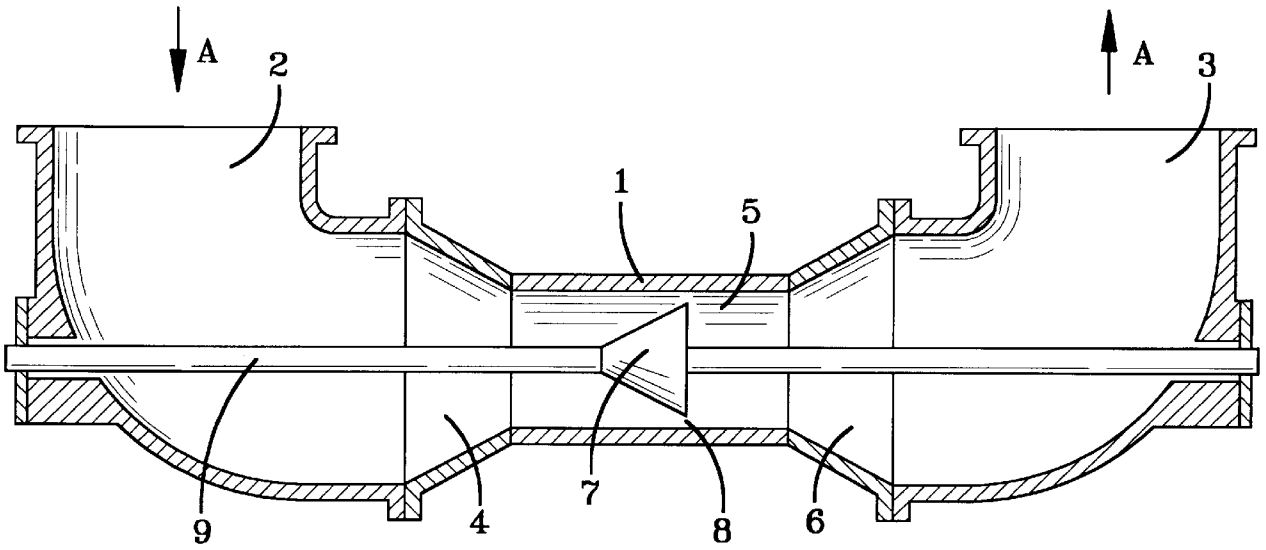
FIG. 1 is a schematic of a longitudinal-section view of a device for carrying out the herein-proposed method into effect, featuring a cone-shaped baffle body.
Figure 2:
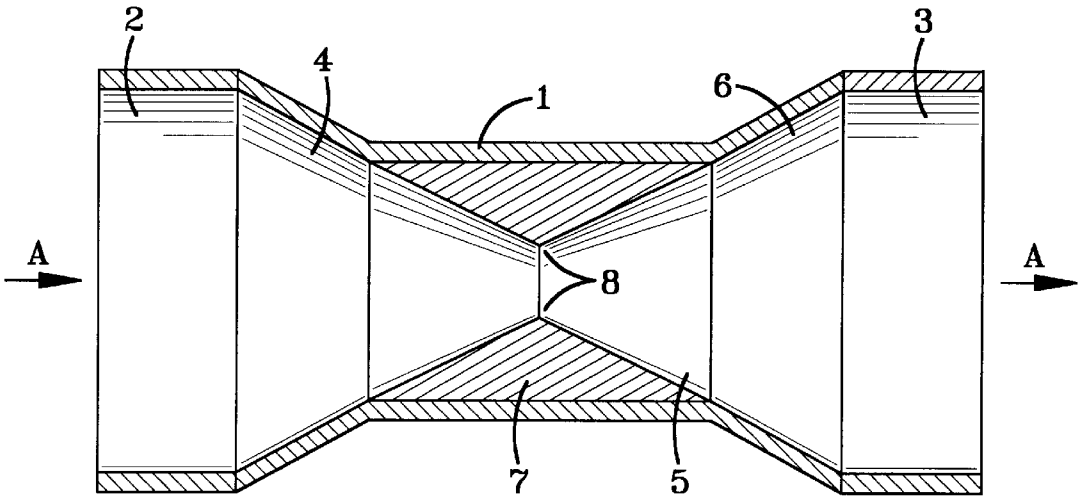
FIG. 2 is a longitudinal-section view of another embodiment of a device for carrying out the herein-proposed method into effect, featuring a flow-throttling baffle body shaped as the Venturi tube.

A device schematically presented in FIGS. 1 and 2 is used for carrying into effect the method, according to the invention.

Reference is now being directed to the accompanying Drawings: FIG. 1 presents the device, comprising a housing 1 having an inlet opening 2 and an outlet opening 3, and arranged one after another and connecting to one another a convergent nozzle 4, a flow-through passage 5, and a divergent nozzle 6.

The flow-through passage 5 accomodates a frustum-conical baffle body 7 which establishes a local flow constriction 8 having an annular cross-sectional profile design. The baffle body 7 is held to a rod 9 coaxially with the flow-through passage 5.

The hydrodynamic flow of a mixture of liquid hydrocarbons moves along the arrow A through the inlet opening 2 and the convergent nozzzle 4 to enter into the flow-through passage 5 and moves against the baffle body 7.

Further along, the flow passes through the annular local constriction 8. When flowing about the cone-shaped baffle body 7, a cavity is formed past the baffle body which, after having been separated, the cavity is disintegrated in the flow into a mass of cavitation bubbles having different characteristic dimensions. The resulting cavitation field, having a vortex structure, makes it possible for processing liquid hydrocarbons throughout the volume of the flow-through passage 5.

The hydrodynamic flow moves the bubbles to the increased pressure zone, where their coordinated collpasing occurs, accompanied by high local pressure (up to 1500 MPa) and temperature (up to 15,000° K.), as well as by other physico-chemical effects which initiate the progress of chemical reactions in the mixture of liquid hydrocarbons that change the composition of the mixture.

After the flow of a mixture of liquid hydrocarbons is processed in the cavitation field, the qualitatively and quantitatively changed mixture of hydrocarbons flow is then discharged from the device through the divergent nozzle 6 and the outlet opening 3. The qualitative and quantitative composition of hydrocarbons was then evaluated by the gas chromatography technique with the aid of a Hewlett-Packard Model A-5890 gas chromatograph equipment.

FIG. 2 presents an alternative embodiment of the device for carrying into effect the herein-proposed method, according to the invention, characterized in that the baffle body 7 is shaped as the Venturi tube and fitted on the wall of the flow-through passage 5. The local flow constriction 8 is established at the center of the flow-through passage 5.

The hydrodynamic flow of liquid hydrocarbons flowing along the direction of the arrow A arrives at the flow-through passage 5 and is throttled while passing through the annular local constriction 8. The resultant hydrodynamic field is featured by its high intensity which is accounted for by the high flow velocity and pressure gradient. The stationary-type cavitation voids are relatively oblong-shaped, and, upon their disintegration, form rather large-sized cavitation bubbles which, when collapsing, possess high energy potential. This cavitation field provides for a considerable change in the qualitative and quantitative composition of a mixture of liquid hydrocarbons.

In order to control the intensity of the hydrodynamic cavitation field, the baffle body 7 placed in the flow-through passage 5 is shaped as a sphere, ellipsoid, disk, impeller as shown in FIGS. 3A–3D, respectively.

Figure 3A:
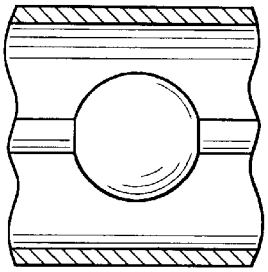
FIG. 3A–3D is a fragmentary longitudinal-section view of a flow-through passage of the device of FIG. 1, featuring the diversely shaped baffle body.
Figure 3B:
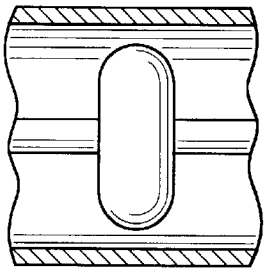

Moveable cavitation voids develop past the baffle body 7 shaped as a sphere or ellipsoid (FIGS. 3A, B). Cavitation bubbles, resulting from disintegrated voids and then collapsing in the increased pressure zone, exert a more "severe" effect on the mixture of hydrocarbons under processing, because the energy potential of the resultant cavitation field is adequately high. This being the case, a considerable change occurs in the qualitative and quantitative composition of hydrocarbons.

The process of chemical transformations of hydrocarbons in the cavitation field, developing past the disk-shaped baffle body 7 (FIG. 3C), proceeds as described with reference to the embodiment of FIG. 1. When the impeller-shaped baffle body 7 is used (FIG. 3D), the hydrodynamic flow is made to rotate, and a relatively larger amount of liquid hydrocarbons under processing are involved in the formed vortex cavitation field than in the case of the baffle bodies 7, described before.

Though the energy potential of the cavitation field is relatively low, a qualitative change of the hydrocarbons under processing is quite adequate.

When using the baffle body 7 shaped as a washer, perforated disk, or bushes having conical or toroidal internal wall surfaces as shown in FIGS. 4A–4D, respectively, the flow is throttled at the local flow constriction locations 8, which results in a local flow zone featuring high transverse velocity gradients. The baffle bodies 7 (FIGS. 4A, B, D) establish the constriction locations 8 at the center of the flow-through passage 5, while the disk-shaped baffle body 7 (FIG. 4B) establishes the constrictions arranged parallel to one another in the same cross-section of the passage 5.

With such a geometry of the baffle bodies, the flow of a mixture of liquid hydrocarbons gets separated, which promotes the development of a cavitation field having high energy potential due to the formation of the lower pressure zone within the local areas of high transverse velocity gradients around the sink flow streams. In this case, the degree of chemical transformations of hydrocarbons is very high.

The hydrodynamic flow of a mixture of hydrocarbons is fed to the device by a pump. Depending on a required result of the technological process, the flow may be fed through the device either once or repeatedly according to recycle pattern Some specific examples of embodiments describing practical implementation of the method and carried out on pilot specimens of the device, according to the invention, as presented in FIGS. 1 and 2, are described as follow:

EXAMPLE 1

The hydrodynamic flow of a mixture of liquid hydrocarbons having a temperature of 12° C. is fed at a rate of 6.90 m/sec. through the inlet opening 2 to the device as shown in FIG. 1. A static pressure at the inlet of the flow-through passage 5 is 0.226 MPa, and, at the outlet, 0.058 MPa. The flow restriction coefficient is 0.4.

The flow of hydrocarbons, while passing along the flow-through passage 5 and flowing about the cone-shaped baffle body 7, is subjected to the cavitation effect which initiates the progress of chemical reactions of decomposition, isomerization, cyclization, and, synthesis, resulting in a change in the qualitative and quantitative composition of the mixture of liquid hydrocarbons. The degree of cavitation is maintained at 2.3.

TABLE 1

| No. | Component name of mixture of hydrocarbons | Qty, wgt. % Original Mix | Qty, wgt. % After Cavitation |
|---|---|---|---|
| 1 | n-Heptane | 0.11504 | 0.14879 |
| 2 | 1,2-Dimethylhexane | — | 0.68847 |
| 3 | 2-Methylheptane | 0.61088 | 0.51834 |
| 4 | 4-Methylheptane | 0.25901 | 0.22089 |
| 5 | 3-Methylheptane | 0.88853 | 0.83008 |
| 6 | n-Octane | 97.25901 | 93.28211 |
| 7 | UNIDENTIFIED | — | 0.03763 |
| 8 | 2,4-Methyloctane | 0.13545 | 0.29003 |
| 9 | 3-Methyloctane | 0.06794 | 0.08449 |
| 10 | n-Nonane | 0.54939 | 0.86537 |
| 11 | 2-Methylnonane | 0.06918 | 0.07128 |
| 12 | n-Decane | 0.05657 | 0.63418 |

EXAMPLE 2

Figure 3C:
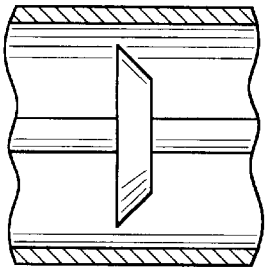

The hydrodynamic flow of a mixture of liquid hydrocarbons having a temperature of 21° C. is fed at a rate of 7.10 m/sec. through the inlet opening 2 to the device as shown in FIG. 1. having the baffle body 7 as shown in FIG. 3C. The static pressure at the inlet of the flow-through passage 5 is 0.265 MPa, and, at the outlet of the passage 5, 0.105 MPa, the flow restriction coefficient being 0.45.

The flow of hydrocarbons, while passing along the flow-through passage 5 and flowing about the disk-shaped baffle body 7, is subjected to the cavitation effect which initiates the progress of chemical reactions of decomposition, isomerization, cyclization, and, synthesis, resulting in a change in the qualitative and quantitative composition of the mixture of liquid hydrocarbons. The degree of cavitation is maintained at 2.50.

The obtained qualitative and quantitative change in the original mixture of liquid hydrocarbons resulting from the cavitation effect is tabulated in Table 2 below.

TABLE 2

| No. | Component name of mixture of hydrocarbons | Qty, wgt. % Original Mix | Qty, wgt. % After Cavitation |
|---|---|---|---|
| 1 | Propane | 0.22193 | 0.29010 |
| 2 | i-Butane | 0.33919 | 0.37508 |
| 3 | n-Butane | 1.01283 | 1.30383 |
| 4 | i-Pentane | 1.57685 | 1.79184 |
| 5 | n-Pentane | 1.88127 | 2.26947 |
| 6 | 2-Methylpentane | — | 0.45404 |
| 7 | 4-Methylpentane | 2.27420 | 2.02959 |
| 8 | 3-Methylpentane | 1.09896 | 1.19428 |
| 9 | n-Hexane | 2.92141 | 3.21366 |
| 10 | Benzene | 2.03052 | 2.57670 |
| 11 | Cyclohexane | 0.13368 | 0.15550 |
| 12 | Toluene | 5.64037 | 6.48683 |
| 13 | Methylcyclohexane | 0.58207 | 0.81869 |
| 14 | n-Octane | 4.45212 | 3.51787 |
| 15 | Dimethylheptane | 1.02500 | 1.12309 |
| 16 | mn-Xylene | 6.14300 | 6.39939 |
| 17 | o-Xylene | 1.28685 | 1.41242 |
| 18 | n-Nonane | 2.93368 | 2.70070 |
| 19 | 3-Methylheptane | 0.09768 | 0.08825 |
| 20 | $C_9$-Alkylbenzenes | 6.82567 | 6.51866 |
| 21 | n-Decane | 2.96542 | 1.90340 |
| 22 | n-Undecane | 0.02413 | — |

EXAMPLE 3

The hydrodynamic flow of a mixture of liquid hydrocarbons having a temperature of 25.4° C. is fed at a rate of 7.35 m/sec. through the inlet opening 2 to the device as shown in FIG. 2. The static pressure at the inlet of the flow-through passage 5 is 0.258 MPa, and, at the outlet of the passage 5, 0.118 MPa, the flow restriction coefficient being 0.50.

The flow of hydrocarbons, while passing along the flow-through passage 5 and through the annular flow construction 8 established by the baffle body 7 shaped as the Venturi tube, is subjected to the cavitation effect which initiates the progress of chemical reactions of decomposition, isomerization, cyclization, and, synthesis, resulting in a change in the qualitative and quantitative composition of a mixture of liquid hydrocarbons. The degree of cavitation is maintained at 2.55.

The obtained qualitative and quantitative change in the original mixture of liquid hydrocarbons resulting from the cavitation effect is tabulated in Table 3 below.

TABLE 3

| No. | Component name of mixture of hydrocarbons | Qty, wgt. % Original Mix | Qty, wgt. % After Cavitation |
|---|---|---|---|
| 1 | 1,2-Dimethylhexane | — | 1.43482 |
| 2 | n-Octane | 0.04844 | 0.28183 |
| 3 | n-Nonane | 0.04610 | 0.24178 |
| 4 | 2-Methylnonane | 0.05085 | 0.26179 |
| 5 | 4-Methylnonane | 0.13862 | 0.55417 |
| 6 | 3-Methylnonane | 0.21275 | 0.66980 |
| 7 | n-Decane | 99.50323 | 96.55574 |

EXAMPLE 4

Figure 3D:
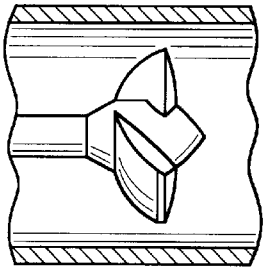
Figure 4A:
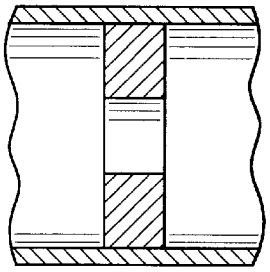
FIG. 4A–4D is a fragmentary longitudinal-section view of a flow-through passage of the device of FIG. 2, featuring a flow-throttling diversely shaped baffle body.
Figure 4B:
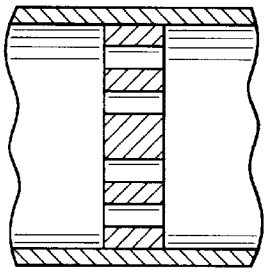
Figure 4C:
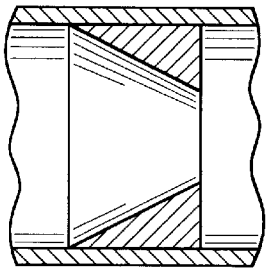
Figure 4D:
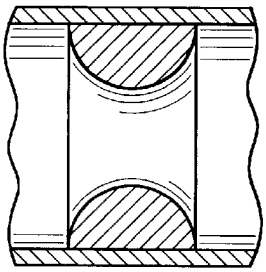

The hydrodynamic flow of a mixture of liquid hydrocarbons having a temperature of 48.6° C. is fed at a rate of 7.66 m/sec. through the inlet opening 2 to the device as shown in FIG. 1. provided with the baffle body as shown in FIG. 3D. The static pressure at the inlet of the flow-through passage 5 is 0.321 MPa, and, at the outlet of the passage 5, 0.135 MPa, the flow restriction coefficient being 0.52, and the degree of cavitation being maintained at 3.1.

The flow of hydrocarbons, while passing along the flow-through passage 5 and flowing about the impeller-shaped baffle body 7, is subjected to the cavitation effect which initiates the progress of chemical reactions of decomposition, isomerization, cyclization, and, synthesis, resulting in a change in the qualitative and quantitative composition of the mixture of liquid hydrocarbons.

The obtained qualitative and quantitative change in the original mixture of liquid hydrocarbons resulting from the cavitation effect is tabulated in Table 4 below.

TABLE 4

| No. | Component name of mixture of hydrocarbons | Qty, wgt. % Original Mix | Qty, wgt. % After Cavitation |
|---|---|---|---|
| 1 | Isobutane | — | 0.7 |
| 2 | n-Butane | 0.3 | 22.1 |
| 3 | Isopentane | 0.9 | 11.4 |
| 4 | n-Pentane | 4.6 | 28.8 |
| 5 | Neopentane | 0.2 | 0.5 |
| 6 | 2,2-Dimethylbutane | 12.2 | 8.9 |
| 7 | Cyclopentane | 15.5 | 8.5 |
| 8 | 2,3-Dimethylbutane | 0.7 | 0.3 |
| 9 | 2-Methylpentane | 7.9 | 2.7 |
| 10 | 3-Methylpentane | 3.3 | 1.0 |
| 11 | n-Hexane | 8.0 | 2.5 |
| 12 | 2,2-Dimethylpentane | 0.2 | 0.06 |
| 13 | Methylcyclopentane | 4.2 | 1.3 |
| 14 | 2,4-Dimethylpentane | 0.1 | 0.03 |
| 15 | Benzene | 6.7 | 2.2 |

TABLE 4-continued

| No. | Component name of mixture of hydrocarbons | Qty, wgt. % Original Mix | Qty, wgt. % After Cavitation |
|---|---|---|---|
| 16 | Cyclohexane | 7.9 | 2.3 |
| 17 | 2,2,3-Trimethylbutane | 0.5 | 0.5 |
| 18 | 3,3-Dimethylpentane | 1.9 | 0.2 |
| 19 | 3-Methylhexane | 0.5 | 0.1 |
| 20 | 2-Methylhexane | 1.1 | 0.3 |
| 21 | n-Heptane | 2.7 | 0.8 |
| 22 | 2,2,3,3-Tetramethylbutane | 0.05 | 0.03 |
| 23 | 2,2-Dimethylhexane | 6.8 | 1.9 |
| 24 | 2,4-Dimethylhexane | 0.3 | 0.07 |
| 25 | 1,2,4-Trimethylcyclopentane | 0.2 | 0.04 |
| 26 | 1,2,3-Trimethylcyclopentane | 0.1 | 0.03 |
| 27 | Toluene | 4.2 | 1.2 |
| 28 | 2,3,4-Trimethylcyclopentane | 0.6 | 0.1 |
| 29 | 2,2,3-Trimethylpentane | 1.1 | 0.3 |
| 30 | 2-Methylheptane | 0.3 | 0.2 |
| 31 | n-Octane | 0.4 | 0.2 |
| 32 | 2,2,5-Trimethylhexane | 0.2 | 0.1 |
| 33 | 2,2,4-Trimethylhexane | 0.1 | 0.09 |
| 34 | 2,3,5-Trimethylhexane | 0.1 | 0.05 |
| 35 | 2,5-Dimethylhexane | 0.4 | 0.1 |
| 36 | 3,5-Dimethylhexane | 0.2 | 0.04 |
| 37 | o-Xylene | 0.2 | 0.05 |
| 38 | o-Xylene | 0.9 | 0.2 |
| 39 | 3-Methyloctane | 0.1 | 0.02 |
| 40 | o-Xylene | 0.2 | 0.04 |
| 41 | n-Nonane | 0.3 | 0.06 |

I claim:

1. A method for changing the qualitative and quantitative composition of a mixture of only liquid hydrocarbons, comprising the steps of:

establishing a flow-through passage using a baffle body that provides a first local constriction;

passing said mixture of only liquid hydrocarbons through said flow-through passage at a velocity that establishes a hydrodynamic cavitation field downstream from said baffle body;

controlling said hydrodynamic cavitation field to maintain a degree of cavitation of at least one; and, initiating chemical transformations within said mixture of only liquid hydrocarbons within said hydrodynamic cavitation field thereby changing the qualitative and quantitative composition of said mixture of only liquid hydrocarbons without the use of a catalyst.

2. The method of claim 1 wherein the steps are accomplished without pre-heating said mixture of liquid hydrocarbons.

3. The method of claim 1 wherein, the step of establishing a flow-through passage using a baffle body that provides a first local constriction, comprises the step of:

establishing said first local constriction at or close to a center of said first flow-through passage.

4. The method of claim 1 wherein, after the step of establishing a flow-through passage using a baffle body that provides a first local constriction, the method comprises the step of:

providing a second local constriction using said baffle body.

5. The method of claim 4 wherein said first and second local constrictions are arranged parallel to one another within said flow-through passage.

6. The method of claim 1 wherein said first local constriction is provided having a coefficient of restriction equal to at least 0.1.

7. The method of claim 1 wherein said mixture of liquid hydrocarbons is maintained at a temperature within the range of 10° C. and 500° C. at said first local constriction.

8. The method of claim 1 wherein said baffle body is shaped as a Ventui tube.

9. The method of claim 1 wherein said baffle body is impeller shaped.

10. The method of claim 1 wherein the steps are repeated at least once.

11. The method of claim 1 wherein said mixture of liquid hydrocarbons is initially at ambient temperature.

12. A method for changing the qualitative and quantitative composition of a mixture of only liquid hydrocarbons, comprising the steps of:

establishing a flow-through passage using a baffle body that provides a first local constriction;

passing said mixture of only liquid hydrocarbons through said flow-through passage at a velocity that establishes a hydrodynamic cavitation field downstream from said baffle body;

controlling said hydrodynamic cavitation field to maintain a degree of cavitation of at least one, and, initiating chemical transformations within said mixture of only liquid hydrocarbons in the form of microcracking produced by collapsing cavitation bubbles within said hydrodynamic cavitation field thereby changing the qualitative and quantitative composition of said mixture of only liquid hydrocarbons without the use of a catalyst.

13. The method of claim 12 wherein the steps are accomplished without pre-heating said mixture of liquid hydrocarbons.

14. The method of claim 12, wherein, the step of establishing a flow-through passage using a baffle body that provides a first local constriction, comprises the step of:

establishing said first local constriction at or close to a center of said first flow-through passage.

15. The method of claim 12 wherein, after the step of establishing a flow-through passage using a baffle body that provides a first local constriction, the method comprises the step of:

providing a second local constriction using said baffle body, said first and second local constrictions being arranged parallel to one another within said flow-through passage.

16. The method of claim 12 wherein said first local constriction is provided having a coefficient of restriction equal to at least 0.1.

17. The method of claim 12 wherein said mixture of liquid hydrocarbons is maintained at a temperature within the range of 10° C. and 500° C. at said first local constriction.

18. The method of claim 12 wherein the steps are repeated at least once.

19. The method of claim 12 wherein said mixture of liquid hydrocarbons is initially at ambient temperature.

20. A method for changing the qualitative and quantitative composition of a mixture of only liquid hydrocarbons, comprising the steps of:

establishing a flow-through passage using a baffle body that provides a first local constriction having a coefficient of restriction equal to at least 0.1 located at or close to a center of said first flow-through passage;

passing said mixture of only liquid hydrocarbons through said flow-through passage at a temperature with the range of 10° C. and 500° C. and at a velocity that establishes a hydrodynamic cavitation field downstream from said baffle body;

controlling said hydrodynamic cavitation field to maintain a degree of cavitation of at least one; and, initiating chemical transformations within said mixture of only liquid hydrocarbons within said hydrodynamic cavitation field thereby changing the qualitative and quantitative composition of said mixture of only liquid hydrocarbons without the use of a catalyst and without pre-heating said mixture of only liquid hydrocarbons.

* * * * *